United States Patent [19]

Gulati et al.

[11] Patent Number: 5,035,541

[45] Date of Patent: Jul. 30, 1991

[54] RUBBLE-SPRAY ICE ISLAND

[75] Inventors: Kailash C. Gulati; Anton Prodanovic, both of Dallas, Tex.

[73] Assignee: Mobil Oil Corporation, Fairfax, Va.

[21] Appl. No.: 560,534

[22] Filed: Jul. 30, 1990

[51] Int. Cl.[5] ..... E02B 17/00

[52] U.S. Cl. ..... 405/217; 405/61

[58] Field of Search ..... 405/130, 195, 211, 217, 405/224, 61; 62/259.61, 260

[56] References Cited

U.S. PATENT DOCUMENTS

| | | | |
|---|---|---|---|
| 3,738,114 | 6/1973 | Bishop | 405/217 |
| 3,750,412 | 8/1973 | Fitch et al. | 405/217 |
| 3,931,715 | 1/1976 | Fitch et al. | 405/217 |
| 4,048,808 | 9/1977 | Duthweiler | 405/217 |
| 4,325,656 | 4/1982 | Bishop | 405/217 |
| 4,326,822 | 4/1982 | Oshima et al. | 405/217 |
| 4,523,879 | 6/1985 | Finucane et al. | 405/217 |
| 4,699,545 | 10/1987 | Chen et al. | 405/217 |
| 4,828,431 | 5/1989 | Chen | 405/217 |

FOREIGN PATENT DOCUMENTS

| | | | |
|---|---|---|---|
| 1092241 | 5/1984 | U.S.S.R. | 405/217 |

OTHER PUBLICATIONS

"Exxon testing spray barrier", Offshore, Jul. 5, 1984, p. 38 et sec.

"Artificial ice islands could cut Arctic costs", The Oil and Gas Journal, Nov. 11, 1974, p. 173 et sec.

"Application of Spray Ice and Rubble Ice for Arctic Offshore Exploration", Goff et al., Offshore Mechanics & Eng. Symposium, Tokyo, Japan, 1986.

*Primary Examiner*—David H. Corbin

*Attorney, Agent, or Firm*—Alexander J. McKillop; Charles J. Speciale; George W. Hager, Jr.

[57] ABSTRACT

A method and apparatus for constructing an ice structure in deep (e.g. 50 feet) waters having a moving sheet of ice on the surface. A rubble generator is positioned in the path of the ice sheet and a portion of the marine bottom is artificially raised adjacent to and on the upstream side of the generator by submerging at least one berm onto the marine bottom. The height of the berm is such that it artificially raise the marine bottom to a depth which is less than the original keel depth of a pile of ice rubble formed when the moving ice sheet interacts with the generator thereby the rubble pile will be spontaneously grounded and immobilized on the berm. Once the rubble pile is grounded, additional ice (e.g. spray-ice) is accumulated thereon to complete the ice structure.

20 Claims, 3 Drawing Sheets

FIG. 1
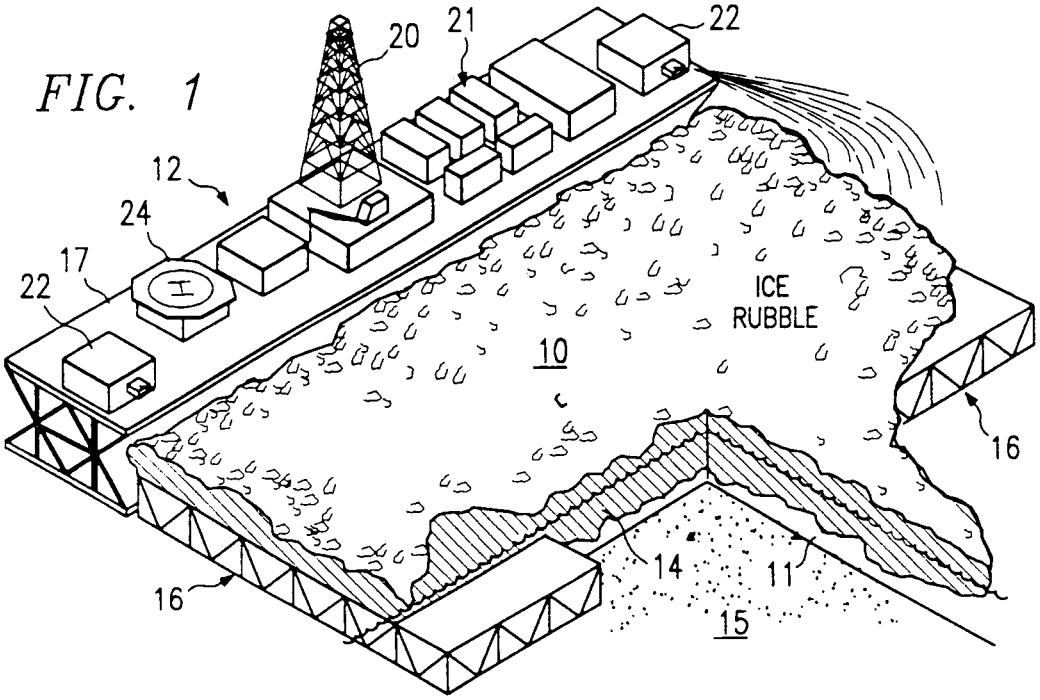
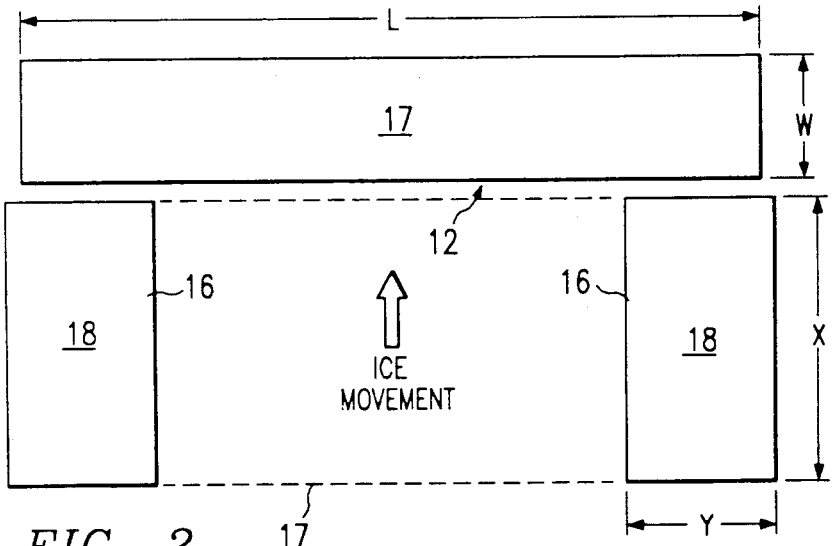
FIG. 2
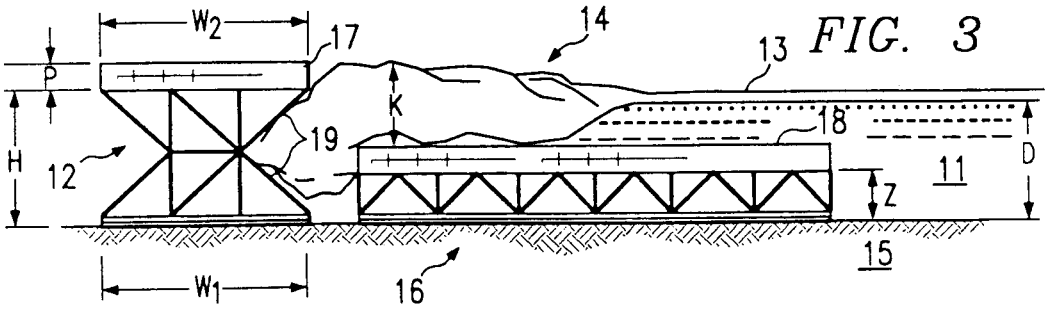
FIG. 3

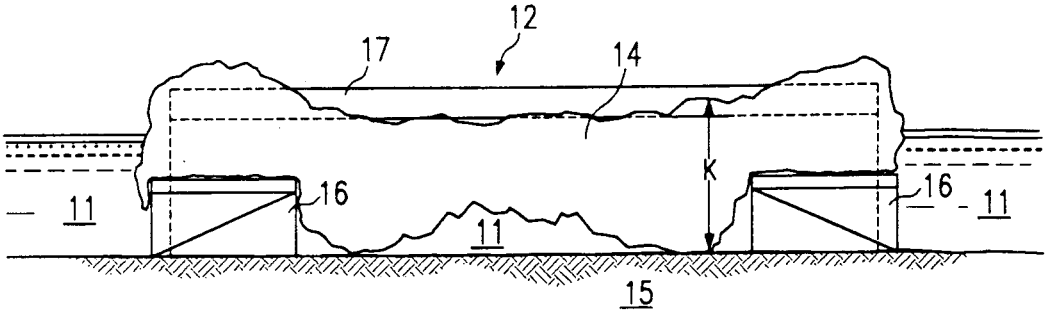
FIG. 4
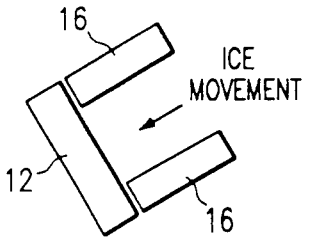
FIG. 5A
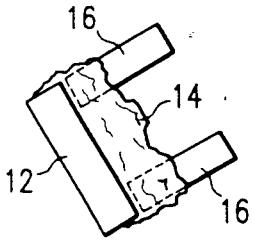
FIG. 5B
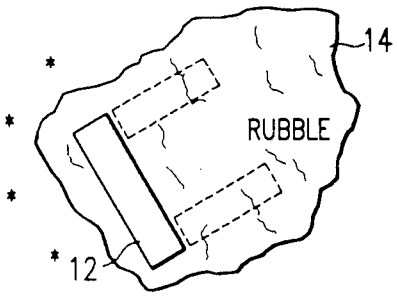
FIG. 5C
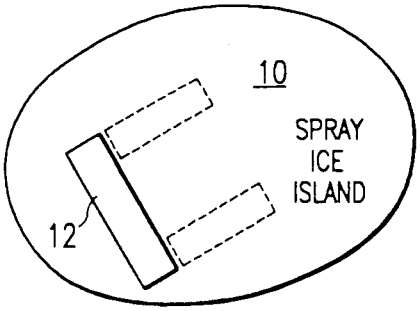
FIG. 5D
FIG. 6
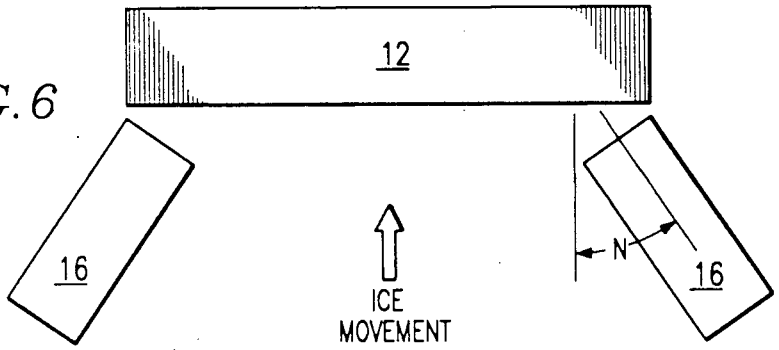

RUBBLE-SPRAY ICE ISLAND

DESCRIPTION

1. Technical Field

The present invention relates to artificial ice islands and in one of its preferred aspects relates to a method and apparatus for constructing an offshore ice structure by accumulating spray-ice onto a base of ice rubble which is formed by a rubble generator and which is grounded on a berm or berms positioned adjacent the generator.

2. Background Art

Artificial or man-made "ice islands" have been constructed and used in the exploration and drilling of hydrocarbon reservoirs which lie in arctic waters. An artificial ice island is an offshore structure which is formed in situ by spraying and/or flooding water onto a base (e.g., a sheet of naturally-occurring ice) during those months when the ambient temperature is well below freezing. As the water is sprayed into the frigid air over the base, it breaks into droplets and freezes to accumulate as spray-ice on the base. This spraying operation, with intermittent breaks for spray-ice curing, continues until the ice mass or island is of sufficient size to ground itself on the marine bottom while providing the surface area and the freeboard required for carrying out the desired operations. For several examples of offshore ice structures which are formed by various spraying and/or flooding techniques, see U.S. Pat. Nos. 3,738,114; 3,750,412; 3,931,715; 4,048,808; 4,325,656; 4,326,822; 4,523,879; and 4,699,545.

At least two major considerations are involved in the success of constructing an ice island at a particular location. First, the base on which spray-ice is to be accumulated must stabilize (i.e. not move when other floating ice experiences large movement) on site at an early enough date in the freezing season to insure adequate time both for constructing the island and for carrying out the due to rising temperatures.

Second, the stability of ice must continue throughout the time (e.g. 30 to 75 days) required to complete the construction of the island through at least the grounding stage. As used here, "stability" can be defined as a condition of the floating ice experiencing only small movements (about 10 meters) and only small cracks (e.g. from 1 to 2 meters) opening therein in response to large ice shearing events.

In most known prior art ice structures as described above, a floating sheet of naturally-occurring ice is used as the base for the structure. Spray-ice is deposited thereon until the resulting ice mass is grounded on the marine bottom. The ice sheet in near-shore, shallow arctic waters (e.g. Beaufort Sea) typically grows to more than a two-foot thickness by mid-November. By this time, the ice sheet is also "landfast" and thus is rendered immobile in shallow water depths, e.g. about 10 meters or less. Once the ice base is substantially immobile, construction of the island can begin.

However, in deep arctic waters, e.g. 15 meters, the naturally-occurring ice sheet does not normally stabilize until January and subsequent movements of the ice field may still be too great to permit safe construction of an ice island. Late start of construction due to the late stabilization of the floating ice sheet coupled with the amount of spray-ice that must be accumulated makes the use of a naturally-occurring ice sheet as the base for a spray-ice island infeasible in deep waters. Therefore, if a spray-ice island is to be constructed in deep waters, some other stable base needs to be provided on which the spray-ice can be accumulated.

The use of ice rubble to form the base for an ice island in deep waters is one such alternative, see "APPLICATION OF SPRAY ICE AND RUBBLE ICE FOR ARCTIC OFFSHORE EXPLORATION, R. D. Goff et al, Offshore Mechanics and Arctic Engineering (OMAE), 5th International Symposium, Tokyo, Japan, 1986. The ice rubble is formed by placing an obstruction (e.g. rubble generator) which is supported on the marine bottom in the path of a moving ice sheet which breaks up into rubble and accumulates in front (upstream) of the generator upon contact therewith. Spray-ice is then accumulated on the floating rubble base to form a grounded ice island which can then be used as a stable platform for exploratory drilling or the like.

The advantages of using ice rubble as the base for an ice island are many. Since most of the rubbling occurs in thin, mobile ice, the rubbling process and island construction can be initiated early in the fall at most locations of interest (e.g., deep, arctic waters). The thickness of the rubble mass also reduces the amount of spray-ice needed to complete the island. Further, the bottom-supported, rubble generator can serve as a stable support for the drilling rig and other equipment. This allows the drilling equipment to be installed by marine vessels at an early date during the open water period. Rubble base islands also allow drilling schedules to be advanced since the island construction can be completed early and any large settlements of the spray ice mass during the initial periods of island use will not directly affect the equipment.

In order to use the floating ice rubble as the base for a spray-ice island, the rubble must remain on site in front (upstream) of the rubble generator until it becomes grounded by a spray ice surcharge and hence, immobilized. Unfortunately, especially in deep waters, an unconsolidated pile of ice rubble is likely to disintegrate and float away, at least at the edges, before sufficient spray ice can be deposited thereon to ground the pile.

That is, any pile of ice rubble which is to be used as a base for a spray-ice island must be able to withstand interaction with moving ice sheets and must be sufficiently strong to accept spray-ice deposits without disintegrating. This requires the ice rubble mass to ground itself spontaneously without the aid of spray ice or surcharges before it begins to break-up and float away.

Accordingly, for ice rubble to be used successfully as a base for an ice island in deep arctic waters where the thickness of the initial ice sheet is around 2 feet or so, some means must be provided to ground and stabilize the rubble before the accumulated rubble begins to disintegrate and float away.

DISCLOSURE OF THE INVENTION

The present invention provides a method and apparatus for constructing an ice structure in deep (e.g., 15 meters), arctic waters which have sheets of ice moving on the surface. A pile of ice rubble is generated from the moving ice sheet and is spontaneously grounded to provide a base on which additional ice is accumulated to complete the structure.

More specifically, the present invention involves positioning an ice rubble generator in the path of the moving ice sheet at the desired construction site. The generator is a structure having a height greater than the depth of the water so that it will rest on the marine bottom and extend above the surface where it interacts with the moving ice to generate a pile of ice rubble. A portion of the marine bottom is artificially raised adjacent to and on the upstream side of the generator to a depth at which the rubble will be spontaneously grounded before it breaks up and floats away (e.g., a depth of 6–9 meters below the surface).

The marine bottom is artificially raised by positioning at least one submerged berm on the upstream side of the generator. Preferably, the berm is actually two elongated berms which are positioned at either end of the rubble generator with their longitudinal axis at an angle (e.g. 90°) with respect to the longitudinal axis of the generator. The berms may be steel-framed structures or may be particulate material (e.g. gravel) piled on the marine bottom. The height of each berm is such that it will artificially raise the marine bottom to a depth such that the rubble pile being formed will spontaneously ground on the berms thereby trapping the pile in place.

Where a single berm extends across the front of the generator, the rubble pile will effectively be grounded throughout its entire length adjacent the generator. However, where two berms are used as described above, a combined grounded and floating rubble pile will exist with the grounded rubble on the berms at the ends of the generator trapping the floating rubble in between.

Once the stable rubble pile is established, additional ice is accumulated thereon by spraying water into the frigid air where it freezes and falls onto the rubble pile and accumulates as spray-ice to complete the structure. The spray ice can be reinforced by adding particulate material (e.g. gravel) to the water before it freezes.

BRIEF DESCRIPTION OF THE DRAWINGS

The actual construction, operation, and the apparent advantages of the present invention will be better understood by referring to the drawings in which like numerals identify like parts and in which:

FIG. 1 is a perspective view, partly broken away, of a rubble-spray ice island being formed in accordance with the present invention;

FIG. 2 is a top plan view of a ice rubble generator and two submerged berms in accordance with the present invention;

FIG. 3 is a side view taken along line 3—3 of FIG. 2;

FIG. 4 is a back view taken along line 4—4 of FIG. 2;

FIGS. 5A–5D are plan views showing various stages of construction of a rubble-spray ice island;

FIG. 6 is a plan view of a modified arrangement of the structure of FIG. 2;

BEST KNOWN MODE FOR CARRYING OUT THE INVENTION

Figure 7:
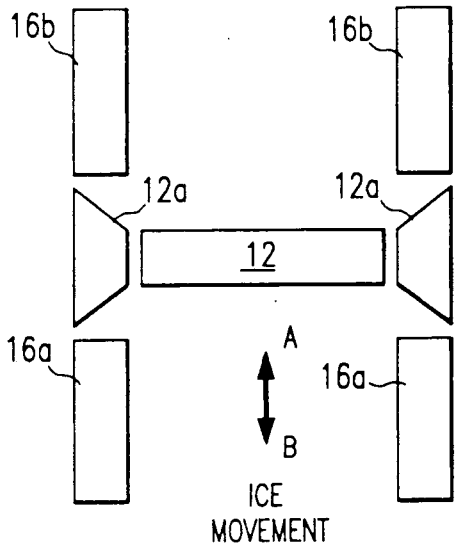
FIG. 7 is a plan view of a another modified arrangement of the structure of FIG. 2 having berms on either side of the rubble generator.

Referring more particularly to the drawings, FIGS. 1–4 illustrate a rubble-spray ice island 10 being formed in deep, arctic waters 11 in accordance with the present invention. An elongated, rubble generator 12 is installed on the marine bottom 15 and extends above the surface. Generator 12 is positioned in the path of a naturally-occurring, moving ice sheet 13 so that the sheet will move against the generator and break up into ice rubble 14. Rubble accumulates as a mass in front of (upstream) of generator 12. In shallow, arctic waters (e.g. less than 10 meters) this mass of ice rubble will be spontaneously grounded (i.e. grounded before breaking up) as it is generated and will provide an immobile base for the construction of a spray ice island.

However, in waters having depths D (FIG. 3) greater than about 10 meters, the mass will not become grounded and will tend to break up and escape around the ends of the generator 12 as new rubble is being formed. This severely hampers efforts to collect enough ice rubble to form an adequate base on which sufficient spray ice can be accumulated for the construction of an ice island.

In accordance with the present invention, "berms" 16 are positioned on the marine bottom 15 at either end of rubble generator 12 on the upstream side thereof. As used herein, "berm" collectively refers to any structure which artificially raises the marine bottom to a depth at which the ice rubble mass formed by generator 12 will be spontaneously grounded. That is, a berm is an artificial shelf or ledge or raised ridge lying below the water surface on which the rubble pile or mass 14 will be grounded as it is formed.

Ideally, the berm would extend across the entire front of the generator 12 (see dotted lines 17 in FIG. 2) but, in most instances, this will be cost prohibitive. Accordingly, as illustrated in FIGS. 1–4, two individual, elongated berms 16 are positioned at the respective ends of generator 12 with their longitudinal axis at an angle with respect to the longitudinal axis of the elongated generator 12. While berms 16 are shown at right angles with respect to generator 12 in FIGS. 1–4, it should be understood that this angle n (FIG. 6) can vary if the situation dictates. Rubble generator 12, together with the flanking, subsea berms 16 form a "corral" which restrains the rubble from escaping once it has become grounded onto berms 16. As the ice sheet 13 continues to flow against generator 12, a rubble pile with grounded sides (on berms 16) and a floating middle will be formed (see FIG. 4).

The average thickness of the floating mid-section **14*a* (FIG. 4) will be less than the depth D of the water but may include some keel depths K which touch and ground onto marine bottom 15. Even though some of the mid-section 14*a* is afloat, both sides of the rubble mass is grounded on berms 16** which effectively makes the entire mass immobile. Water is then sprayed onto this stabilized mass of ice rubble to accumulate spray ice thereon to finish grounding the mid section of the base of rubble and to complete the construction of the ice island.

As illustrated in FIGS. 1–4, the rubble generator 12 is formed of an elongated framework of steel beams and appropriate cross-bracing which has a height H sufficient to allow the generator to be grounded and still extend well above the water surface. As shown, generator 12 has sloping sides 19 (FIG. 3) in the ice interaction zone and has a platform 17 thereon which includes ballast material (e.g., concrete blocks, sand bags, etc.). This material provides dead weight which aids in keeping the generator on station during construction of an ice island. The bottom and top of generator 12 are preferably reinforced with plating for stability.

The berms 16 illustrated in FIGS. 1–4 are also constructed of elongated frames of steel and have platforms 18 on which the ice rubble 14 will ground. Platforms 18 include ballast material (e.g. concrete blocks) which aids in keeping the berms submerged and on location. Preferably, stiffened plate mudmats (not shown) are installed at the bottom of the berms to help maintain them in position on the marine bottom.

All necessary construction and operational equipment (e.g., drilling rig 20, crew facilities 21, spray nozzles and pumps 22, heliport 24 etc., FIG. 1) is preferably located on platform 17 of the generator 12. By locating this equipment on the bottom-supported generator 12, the equipment and supplies can be mobilized and installed during the open water season. This eliminates several very expensive operations such as construction and maintenance of ice roads, helicopter deployment of the drilling equipment, and the like. Also, this eliminates the uncertainties that are inherently involved when the drilling rig is positioned and supported on surface of the spray-ice island, itself. Still further, by locating the spraying equipment on the grounded generator 12, an early start and early completion of the island can be accomplished.

FIGS. 7–10 illustrate other embodiments of the present invention. FIG. 7 discloses apparatus primarily for use in the construction of a rubble-spray ice island in deep, arctic waters where the movement of the floating ice sheets reverse direction with regularity. As shown, rubble generator 12 includes an additional section 12*a* positioned at each end of center section 12. Sections 12*a* are constructed similarly as disclosed above but are shaped so as to generated rubble from a floating ice sheet moving either in direction A or B. Berms 16*a* and 16*b* are positioned on the marine bottom on either side (i.e. front and back), respectively, of generator 12 whereby ice rubble formed when the ice sheet is moving in direction A will ground on berms 16*a* and when moving in direction B will ground on berms 16*b*.

Figure 8:
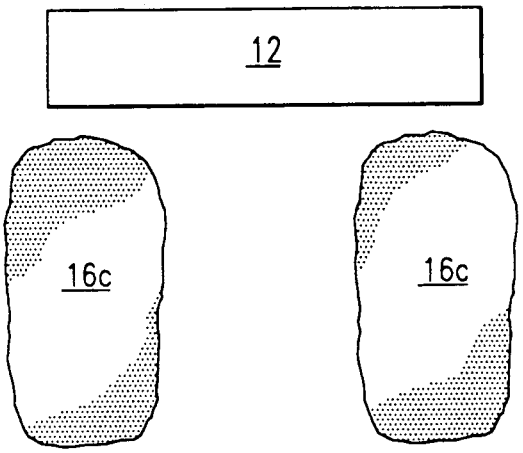
FIG. 8 is a plan view of a further modified arrangement of the structure of FIG. 2 wherein the berms are formed of a grandular material.
Figure 9:
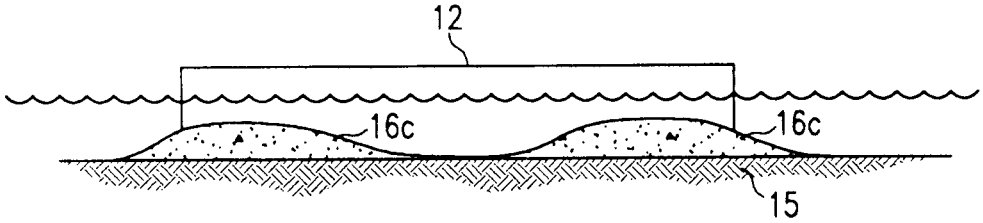
FIG. 9 is a back view taken along line 9—9 of FIG. 8.
Figure 10:
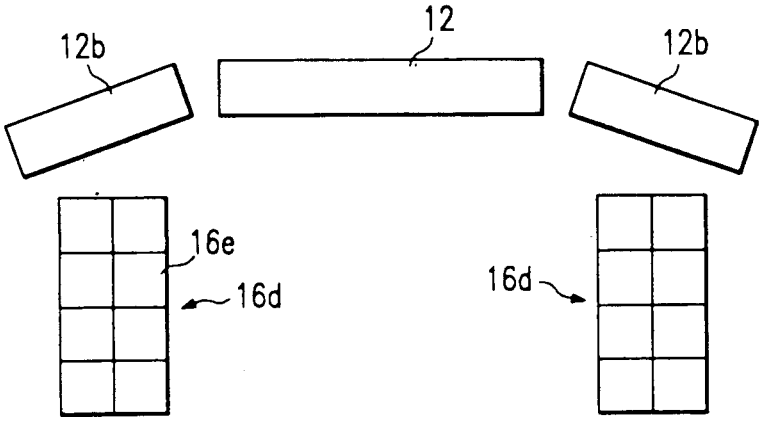
FIG. 10 is a plan view of still another modification of the structure of FIG. 2.

In the embodiment of FIGS. 8–9, berms 16*c* are formed of submerged, elongated mounds or piles of particulate material (e.g. gravel, sand, rocks, etc.) which has been piled onto marine bottom 15. In FIG. 10, rubble generator 12 also includes end sections 12*b* which have been positioned at angles to the center section 12. Further, berms 16*d* have still a different construction in that they are box-like structures which have been internally divided into cells 16*e* which, in turn, are filled with particulate material (e.g. gravel). It should be recognized that various combinations of rubble generators and berms can be used depending on the particular circumstances.

In all of the above-described embodiments, the rubble generator and the berms all function in the same basic manner to achieve the same basic result. That is, the rubble generators all block the path of the moving ice to cause the ice to break into rubble. The berms all effectively raise the marine bottom to a depth at which the rubble formed by the generator will be spontaneously grounded.

To further illustrate the present invention, the following is an example of specific equipment designed in accordance with the present invention for constructing a rubble-spray ice island in deep, arctic waters having a depth D of 50 feet where the island is to have a core diameter of approximately 1000 feet. Looking at FIGS. 2 and 3, a typical rubble generator 12 would have a length L of 500 feet, a height H of 75 feet, a width $W_1$ at the lower end of the structure of 100 feet, and a width $W_2$ of 120 feet. The generator is weighted with a 10 foot layer P of concrete blocks to provide an over-all height of 85 feet. The total weight of the generator is estimated to be 3015 tons. Each berm 16 has a length x of 300 feet, a width y of 100 feet, and a height z of 35 feet topped with a 5 foot layer of concrete blocks thereon.

Generator 12 and berms 16 are constructed onshore and transported to the construction site by conventional barges (not shown) during open water season. Two 400 feet by 100 feet wide barges have sufficient capacity to carry this equipment and a majority of the ballast needed. The barges are anchored near the site and are tilted by taking on water so the generator can be winched off and allowed to float on the water. With the aid of a tug (not shown), the generator is located in the proper orientation at the construction site and is then flooded to sink it into position on the marine bottom. Each berm 16 is installed in basically the same manner. Additional ballast, drilling equipment, construction equipment, etc. are installed on top of the rubble generator.

After the start of freezing season, floating sheets of ice form and quickly reach thicknesses of 2 feet or so. These sheets interact with the generator 12 to form rubble mass 14 which is spontaneously grounded on berms 16 thereby "capturing" the rubble mass and immobilize it in place. Once the rubble mass 14 is immobile, water is sprayed into the air by pumps 22 (FIG. 1) (e.g. 10,000 gpm pumps) to form and accumulate spray-ice on the base of ice rubble 14. This spraying is continued, with occasional breaks for curing and/or reinforcing the spray-ice, until an ice island having the desired size and freeboard is completed. See FIGS. 5A–5D which conceptually illustrate, respectively, various incremental stages of construction of the ice island 10.

Further, the spray-ice may be reinforced while it is being formed by (1) vigorously mixing a particulate material (e.g. sand, gravel, synthetic material, etc.) with the water before the mixture is sprayed into the air; (2) spraying the water and particulate material into the air at the same time from two different systems; and/or (3) introducing the particulate material into the water as the water leaves the spray nozzles. This particulate material may be sand or gravel dredged from the marine bottom or may be supplied from other sources.

If desired, the generator 12 and berms 16 can be recovered and moved to storage or to a new construction site during the ice break-up or thawing season. This is accomplished by flooding the area of the island which surrounds the generator and berms with seawater. As known, this increases the rate of melting of the ice and soon frees the equipment so it can be raised and loaded onto barges for transportation.

What is claimed is:

1. A method for constructing an ice structure in deep, arctic waters having a moving sheet of ice thereon, said method comprising:

positioning a rubble generator in the path of said moving sheet of ice;

raising a portion of the marine bottom adjacent to and on the upstream side of said rubble generator;

allowing ice rubble to accumulate as it is generated by said sheet of ice moving against said rubble generator and to spontaneously ground onto said raised portion to form a grounded pile of ice rubble; and accumulating additional ice onto said grounded pile of ice rubble to form said ice structure.

2. The method of claim 1 wherein said step of accumulating additional ice comprises:

spraying water into the air and allowing said water to freeze and accumulate as spray-ice on said grounded pile of ice rubble.

3. The method of claim 1 wherein the step of raising a portion of the marine bottom comprises:

positioning at least one berm onto the marine bottom adjacent to and on the upstream side of said rubble generator to artificially raise said portion of the marine bottom to a depth less than the keel depth of said pile o said ice rubble.

4. The method of claim 3 wherein said rubble generator comprises an elongated structure having two ends and wherein said at least one berm comprises:

a pair of elongated structures, one submerged and positioned at each of said ends of said rubble generator and each having its longitudinal axis positioned at an angle with respect to the longitudinal axis of said rubble generator.

5. The method of claim 4 wherein said angle is substantially a right angle.

6. The method of claim 3 wherein said at least one berm comprises:

a pair of elongated, mounds of particulate material, one submerged and positioned at each of said ends of said rubble generator and each having its longitudinal axis positioned at an angle with respect to the longitudinal axis of said rubble generator.

7. The method of claim 3 wherein said said elongated structure having an upstream side and a downstream side and wherein said at least one berm comprises:

a pair of elongated structures submerged and positioned on each of said sides of said rubble generator, one of each pair positioned at each of said ends of its respective side of said rubble generator and each having its longitudinal axis positioned at an angle with respect to the longitudinal axis of said rubble generator.

8. The method of claim 3 wherein said step of accumulating additional ice comprises:

spraying water into the air and allowing said water to freeze and accumulate as spray-ice on said grounded pile of ice rubble.

9. The method of claim 8 including: adding reinforcing material to said water before said water freezes to thereby reinforce said spray-ice.

10. The method of claim 9 wherein said reinforcing material comprises a particulate material.

11. Apparatus for constructing an ice structure in deep, arctic waters having a moving sheet of ice thereon, said apparatus comprising:

a rubble generator grounded on the marine bottom of said waters and extending above the surface, said generator positioned in the path of said moving sheet of ice;

means for artificially raising a portion of said marine bottom adjacent to and on the upstream side of said generator to a depth less than the keel depth of the pile of ice rubble which will be formed when said sheet of ice moves against said generator whereby said pile of ice rubble will spontaneously ground onto said means; and means for accumulating additional ice onto said pile of ice rubble after it has become grounded.

12. The apparatus of claim 11 wherein said rubble generator comprises:

an elongated structure having two ends and an upstream side and a downstream side and having a height greater than the depth of said waters;

and wherein said means for raising said bottom comprises:

at least one berm having a height sufficient to artificially raise the marine bottom to a depth less than said keel depth.

13. The apparatus of claim 12 wherein at least one berm comprises:

a pair of elongated structures, one submerged and positioned at each of said ends of said rubble generator and each having its longitudinal axis positioned at an angle with respect to the longitudinal axis of said rubble generator.

14. The apparatus of claim 12 wherein said at least one berm comprises:

a pair of elongated, mounds of particulate material, one submerged and positioned at each of said ends of said rubble generator and each having its longitudinal axis positioned at an angle with respect to the longitudinal axis of said rubble generator.

15. The apparatus of claim 12 wherein said at least one berm comprises:

a pair of elongated structures submerged and positioned on each side of said rubble generator, one of each pair positioned at each of said ends of its respective side of said rubble generator and each having its longitudinal axis positioned at a angle with respect to the longitudinal axis of said rubble generator.

16. The apparatus of claim 12 wherein said means for accumulating additional ice comprises:

means for spraying water into the air and allowing said water to freeze and accumulate as spray-ice on said grounded pile of ice rubble.

17. An ice structure formed in deep, arctic waters comprising:

an ice rubble generator grounded on the marine bottom of said waters and extending above the surface thereof;

at least one submerged berm positioned adjacent to and on the upstream side of said generator;

a pile of ice rubble grounded on said at least one berm; and spray-ice on said pile of ice rubble.

18. The ice structure of claim 17 wherein said at least one berm comprises:

a pair of elongated structures, one submerged and positioned at each of said ends of said rubble generator and each having its longitudinal axis positioned at an angle with respect to the longitudinal axis of said rubble generator and each having a height sufficient to artificially raise the marine bottom to a depth less than the keel depth of said pile of ice rubble when originally formed by said generator.

19. The ice structure of claim 18 wherein said at least one berm comprises:

a pair of elongated, mounds of particulate material, one submerged and positioned at each of said ends of said rubble generator and each having its longitudinal axis positioned at an angle with respect to the longitudinal axis of said rubble generator and having a height sufficient to artificially raise the marine bottom to a depth less than the keel depth of said pile of ice rubble when originally formed by said generator.

20. The ice structure of claim 18 wherein said at least one berm comprises:

a pair of elongated structures submerged and positioned on each side of said rubble generator, one of each pair positioned at each of said ends of its respective side of said rubble generator and each having its longitudinal axis positioned at an angle with respect to the longitudinal axis of said rubble generator and each having a height sufficient to artificially raise the marine bottom to a depth less than the keel depth of said pile of ice rubble when originally formed by said generator.

* * * * *